United States Patent [19]

Baldassarri et al.

[11] Patent Number: 4,822,724

[45] Date of Patent: Apr. 18, 1989

[54] PROCESS FOR THE FORMATION OF STABLE COLOR PHOTOGRAPHIC IMAGES

[75] Inventors: Agostino Baldassarri; Marco Loiacano; Giuseppe Loviglio, all of Savona, Italy

[73] Assignee: Minnesota Mining and Manufacturing Company, St. Paul, Minn.

[21] Appl. No.: 131,674

[22] Filed: Dec. 11, 1987

[30] Foreign Application Priority Data

Dec. 18, 1986 [IT] Italy ..... 22742 A/86

[51] Int. Cl.[4] ..... G03C 5/24; G03C 7/32

[52] U.S. Cl. ..... 430/379; 430/384; 430/385; 430/386; 430/387; 430/389; 430/391; 430/493; 430/959; 430/960

[58] Field of Search ..... 430/379, 384, 385, 386, 430/387, 388, 389, 391, 393, 959, 960

[56] References Cited

U.S. PATENT DOCUMENTS

| | | | |
|---|---|---|---|
| 2,949,360 | 8/1960 | Julian | 430/540 |
| 2,991,177 | 7/1961 | Roth et al. | 430/546 |
| 3,706,556 | 12/1972 | Nagae et al. | 430/379 |
| 3,884,699 | 5/1975 | Cavallo et al. | 96/87 A |
| 3,884,700 | 5/1975 | Quaglia | 96/100 |
| 4,332,885 | 1/1982 | Ohmatsu | 430/379 |
| 4,720,451 | 1/1988 | Shuto et al. | 430/379 |

*Primary Examiner*—Mukund J. Shah

*Attorney, Agent, or Firm*—Donald M. Sell; Walter N. Kirn; Mark A. Litman

[57] ABSTRACT

In a reversal process for the formation of color photographic images which consists of a black and white development (first development) to obtain a first negative image, followed by exposure and/or uniform fogging of the residual silver halide and a further processing (including a second color development), to obtain a second visible (in transparency) color positive image, of a silver halide color multilayer material which comprises, coated on a support base, one or more red-sensitive silver halide emulsion layers associated with dispersed non-diffusing hydrophobic cyan couplers, one or more green-sensitive silver halide emulsion layers associated with dispersed non-diffusing hydrophobic magenta couplers and one or more blue-sensitive silver halide emulsion layers associated with dispersed non-diffusing hydrophobic yellow couplers, the improvement which consists of the reversal development of said magenta-forming layer being performed in the absence of a significant presence of oil.

19 Claims, No Drawings

PROCESS FOR THE FORMATION OF STABLE COLOR PHOTOGRAPHIC IMAGES

FIELD OF THE INVENTION

The present invention refers to a process for obtaining stable photographic images with a silver halide color photographic material exposed and processed to obtain color images in a reversal processing even when the material has been contacted with formaldehyde traces during storage prior to development.

BACKGROUND OF THE ART

In general, a silver halide color photographic material is composed of a support base and silver halide emulsion layers coated thereon, of which each is sensitive or sensitized to a different region of the visible spectrum and contains a coupler capable of reacting with the oxidation products of a color developer to give a dye. For instance, a conventional color photographic material contains silver halide emulsion layers each of which is sensitive or sensitized to red light, to green light and to blue light and contains a cyan, magenta and yellow coupler, respectively. After exposure to light, the photographic material is submitted to color development to form cyan, magenta and yellow color images, respectively.

In particular, a reversal processing for the formation of a color image comprises a black and white development (with hydroquinone-phenidone) of an image-wise exposed multilayer color photographic element, the exposure or uniform fogging of the residual silver halide and the color processing which includes a color development, or second development (with p-phenylene diamine, for example), bleaching, fixing (or bleach-fixing) and a final stabilizing washing. Said color or second development is generally indicated in the photographic art as "reversal development".

To assure the necessary sharpness of the color image, the obtained dyes should not substantially diffuse in the layer where they are formed. To this purpose couplers provided with particular anti-diffusion or ballasting groups are used, which prevent the diffusion thereof. Said couplers are introduced into the photographic layer according to the oil dispersion method. Said method, described for instance in U.S. Pat. Nos. 2,322,027; 2,801,170; 2,801,171; 2,949,360 and 2,991,177, briefly consists of dissolving-the coupler in a high-boiling water-immiscible organic solvent (the oil), mechanically dispersing the solution in a hydrophilic colloid (e.g. gelatin) under the form of very small droplets and adding the obtained dispersion to the silver halide photographic emulsion.

In these multilayer photographic materials, the sensitometric properties (sensitivity, contrast and color maximum density) are well-balanced to obtain the best possible photographic image. The sensitometric properties of the photographic material are therefore desired not to change during storage both prior to and after light exposure untill it is developed.

It is known that formaldehyde and other aldehydes, even in traces in a gaseous state, are capable of reacting with the couplers used for the production of color images and thereby decreasing color density and causing fog formation in color photographic materials. This is especially true with 4-equivalent magenta couplers which have a reactive methylene group, and most particularly with 5-pyrazolone magenta couplers. Care is therefore taken by the manufacturers of color photographic materials to prevent such materials from being exposed (e.g. in the coating and drying plants of the photographic material) to traces of formaldehyde or other aldehydes, compounds which sometimes are used (e.g. as hardeners) in the manufacture of black and white photographic materials.

The photographic material however may come into contact with other formaldehyde traces during storage thereof prior to and after exposure. In manufacturing and commercial environments, objects capable of being sources of formaldehyde traces are often used; for instance building materials and furniture are treated with formaldehyde, there are adhesive substances containing formaldehyde as hardener, containers are made of formaldehyde resins, leathers are tanned with formaldehyde, and cloths are sterilized with formaldehyde. There are therefore many instances where a photographic material may come into contact with formaldehyde traces.

In the art it is known that the negative effect of formaldehyde traces can be decreased by increasing the relative quantity of oil with respect to the coupler to be dispersed, as described for instance in U.S. Pat. No. 4,490,460; the effect however is limited and the physical characteristics of the photographic layer turn out to be damaged by the presence of oil.

It is known as well that the use of 2-equivalent magenta couplers, which are less reactive towards formaldehyde, decreases the negative effect of formaldehyde; said couplers however are often chemically-unstable, have a low reactivity and tend to produce fog.

It has been proposed also to incorporate a compound reacting with formaldehyde into the coupler-containing layer in order to decrease the formaldehyde effect upon the sensitometric properties of the photographic material. Compounds which react with formaldehyde to be used in photographic materials containing 4-equivalent magenta couplers dispersed in oil are described for instance in GB Pat. No. 2,110,832, U.S. Pat. Nos. 3,652,278; 3,770,431; 3,811,891; 4,411,987 and 4,490,460. However, these compounds have some limits: some of them for instance have a limited capability of reacting with gaseous formalin, others are to be used in so large quantities that the physical characteristics of the photographic material are damaged, others interfere with the gelatin hardeners, and others have negative interactions with the photographic characteristics of the photographic material.

In the color photographic art, in particular in the art of the image formation in a color reversal process, there is therefore the need of providing a process which decreases the degradation of the sensitometric properties, such as color density decrease and fog increase in a silver halide color photographic material even when the material has been put into contact with formaldehyde traces for a long storage period prior to being developed.

SUMMARY OF THE INVENTION

The present invention refers to a process for the formation of stable color images upon exposure and reversal development of a color photographic material, said material comprising at least one red-sensitive silver halide emulsion layer associated with dispersed non-diffusing hydrophobic cyan couplers, at least one green-sensitive silver halide emulsion layer associated with dispersed non-diffusing hydrophobic magenta couplers and at least one blue-sensitive silver halide emulsion layer associated with dispersed non-diffusing hydrophobic yellow couplers, characterized by the fact that at least one green-sensitive layer of said material is developed in the presence of a magenta-forming coupler dispersed therein in the absence of a significant presence of oil.

The photographic material according to the process of the present invention keeps the sensitometric properties substantially unchanged, in particular it is stabilized against color density decrease and fog increase, even if placed into contact with traces of formaldehyde or other aldehydes for a long time, both prior to and after exposure, before being developed.

At least one of the green-sensitive layers is formed by coating a composition obtained by adding the silver halide emulsion with a dispersion of the magenta coupler in a gelatin water solution, said dispersion being obtained by dispersing in the gelatin water solution the magenta coupler solution in a low-boiling water-immiscible organic solvent in the presence of an anionic surfactant and, preferably and additionally, also a non-ionic surfactant.

DETAILED DESCRIPTION OF THE INVENTION

In one aspect, the present invention refers to a process for the formation of a color image upon exposure and development, in particular reversal development, of a photographic material comprising a support base and, coated thereon, at least one red-sensitive silver halide emulsion layer associated with dispersed non-diffusing hydrophobic cyan couplers, at least one green-sensitive silver halide emulsion layer associated with dispersed non-diffusing hydrophobic magenta couplers and at least one blue-sensitive silver halide emulsion layer associated with dispersed non-diffusing hydrophobic yellow couplers, characterized by the fact that at least one green-sensitive layer of said material is developed in the presence of a magenta-forming coupler, dispersed therein, in the absence of a significant presence of oil.

In another aspect, the present invention refers to a color photographic material comprising a support base and, coated thereon, at least one red-sensitive silver halide emulsion layer associated with non-diffusing hydrophobic cyan couplers dispersed in oil, at least one green-sensitive silver halide emulsion layer associated with non-diffusing hydrophobic magenta couplers dispersed in the absence of a significant presence of oil and at least one blue-sensitive silver halide emulsion layer associated with non-diffusing hydrophobic yellow couplers dispersed in oil.

In still another aspect, the present invention refers to a process for stabilizing the sensitometric properties of a color photographic material, in particular for stabilizing said material against color density decrease and fog increase even if it has been put into contact with formaldehyde traces for a long time before being developed, said material comprising a support base and, coated thereon, one or more red-sensitive silver halide emulsion layers associated with dispersed non-diffusing hydrophobic cyan couplers, one or more green-sensitive silver halide emulsion layers associated with dispersed non-diffusing hydrophobic magenta couplers and one or more blue-sensitive silver halide emulsion layers associated with dispersed non-diffusing hydrophobic yellow couplers, said process being characterized by coating at least one green-sensitive layer associated with the dispersed magenta coupler in the absence of a significant presence of oil.

The dispersions of the magenta coupler in the absence of oil of the process of the present invention are obtained by dispersing in a gelatin water solution in the presence of an anionic surfactant a solution of the magenta coupler in a low-boiling substantially water-immiscible organic solvent.

Useful organic solvents are those having a water solubility lower than 10 parts by weight per 100 parts of water at 20° C. and a boiling temperature ranging from 50° to 175° C. Typically, solvents within this class, as defined, include those which are used in the conventional coupler-in-oil dispersion method as "auxiliary" solvents in addition to the "primary" solvents or oils (which are high-boiling, organic, crystalloidal, water-insoluble solvents with a boiling point higher than 175° C., have a high solving power for the non-diffusing couplers and the dyes formed therefrom and are permeable to the oxidation products of the color developers). The difference between auxiliary and primary solvents in said conventional coupler-in-oil dispersion method is substantially that drying, occurring in common manufacturing operations for photographic materials, removes the largest part of the auxiliary solvent together with almost the whole water, while it leaves substantially the whole primary solvent in the form of small oil droplets in which the coupler is dissolved. Preferably, the solvents of the present invention include the esters of aliphatic alcohols (preferably aliphatic alcohols having 1 to 10 carbon atoms) with acetic or propionic acid, for instance, ethyl acetate, isopropyl acetate, ethyl propionate, $\beta$-buthoxy-$\beta$-ethoxyethyl acetate.

After having dissolved the magenta coupler in the above said auxiliary solvent, the solution is dispersed in a gelatin water solution in the presence of an anionic surfactant.

Useful anionic surfactants are those normally used in the oil dispersion method, preferably the surfactants having a hydrophobic radical containing from 8 to 25 carbon atoms and a water solubilizing free or salified sulfonic acid group or sulforic ester group, more preferably the surfactants of the arylalkylsulfonate, alkylsulfonate, alkylsulforic ester, N-acyltaurine, N-acyl-N-alkyltaurine and dialkylsulfosuccinate type. Since such anionic surfactants are very soluble in water, they are normally added to the gelatin water solution where the low-boiling organic solvent solution of the magenta coupler is to be dispersed.

In addition and preferably, the dispersion is performed in the presence also of a non-ionic surfactant. Preferred non-ionic surfactants are those having HLB values (i.e. hydrophilic-oleophilic balance values as described in Nonionic Surfactants, Marcel Dekker, Inc., New York, 1967 on pages 607 f.f.) ranging from 4.5 to 9.6. More preferred non-ionic surfactants are the higher fatty acid (e.g. oleic, stearic, palmitic, miristic, caproic acid) esters of the dehydration products of sorbitol and mannitol (i.e. sorbitan and mannitan) and the polyoxyethylenated products thereof. Since such non-ionic surfactants are much more soluble in organic solvents than in water, they are normally added to the low-boiling organic solvent solution of the magenta coupler which is to be dispersed in the gelatin water solution.

The organic solvent solution of the magenta coupler is dispersed in the gelatin water solution by treating the mixture of both solutions with a colloidal mill, a homogenizer or an ultrasound electromagnetic generator. The obtained dispersion can be added to the photographic emulsion either as it is, comprising very small droplets dispersed in gelatin of the low-boiling organic solvent containing dissolved the magenta coupler, or under a more concentrated form, having removed upon evaporation the largest part of the organic solvent further to at least 90% of water, leaving the coupler dispersed in gelatin under the form of microaggregates of 0.01 to 0.2 micron, after re-dispersion in water. The w/w ratio of the total gelatin of the layer to the coupler dispersed therein is preferably lower than 10, more preferably lower than 5.

The magenta couplers to be used in the process of the present invention are couplers characterized by the presence of a reactive methylene group, such as for instance 5-pyrazolone and pyrazolotriazole couplers. Preferably, they are 4-equivalent 5-pyrazolone couplers. More preferably, they are couplers corresponding to the general formula:

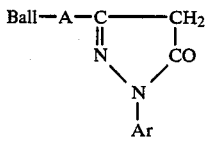

wherein A is a divalent organic group of formula —CONH—, —NH—, —NHCONH— or —NHCOO—, Ar is an aryl group (for instance a phenyl group, an alpha- or beta-naphthyl, etc.) and Ball is an organic ballasting group.

The aryl group may contain one or more substituents such as an alkyl group, an alkenyl group, a cyclic alkyl group, an aralkyl group, a cyclic alkenyl group, a halogen atom, a nitro group, a cyan group, an aryl group, an alkoxy group, an aryloxy group, an alkoxycarbonyl group, an aryloxycarbonyl group, a sulfamoyl group, a carbamoyl group, an acylamino group, a diacylamino group, a ureido group, a urethane group, a sulfonamido group, an arylsulfonyl group, an alkylsulfonyl group, an alkylthio group, an arylthio group, an alkylamino group, a hydroxy group, a mercapto group, etc. Preferred examples of substituents are the low alkyl groups having from 1 to 4 carbon atoms, the low alkoxy groups having from 1 to 4 carbon atoms and halogen atoms. The preferred example of aryl group is 2,4,6-trichlorophenyl group. Typical examples of 5-pyrazolone magenta couplers are disclosed in U.S. Pat. Nos. 2,369,489; 2,343,703; 2,311,082; 2,600,788; 2,908,573; 3,062,653; 3,152,896 and 3,519,429.

The ballasting group (Ball) is an organic radical having a size and configuration such as to make the coupler substantially non-diffusing from the layer of the photographic material where it is incorporated. Representative ballasting groups include substituted and non-substituted alkyl or alkylaryl groups containing a total of carbon atoms from 8 to 32. Preferred ballasting groups are those represented by the formula:

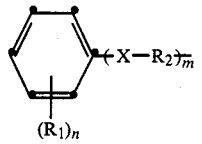

wherein X is an oxygen atom or a sulfur atom, $R_2$ is a branched or linear alkylene group, $R_1$ is a hydrogen atom, a halogen atom, an alkyl group, an aryl group, a heterocyclic group, an aralkyl group, an aryloxy group, a hydroxy group, an acyloxy group, an alkoxycarbonyl group, an aryloxycarbonyl group, an alkylthio group, an arylthio group, an alkylsulfonyl group, an arylsulfonyl group, an acyl group, an acylamino group, a sulfonamido group, a carbamoyl group or a sulfamoyl group which can be also substituted, n is 0, 1, 2 or 3 and m is 0 or 1, with the proviso that the carbon atom sum in $R_1$ and $R_2$ is at least 8. Typical examples of ballasting groups are disclosed in U.S. Pat. No. 4,009,083; in European Pat. Nos. 87,930; 84,100; 87,931; 73,146 and 88,563, in German Pat. Nos. 3,300,412 and 3,315,012 and in Japanese Pat. Nos. 58/33248, 58/33250, 58/31334 and 58/106539.

The 4-equivalent 5-pyrazolone magenta couplers which can be preferably used according to the invention are characterized by a high solubility in the primary solvents (oils) of the oil dispersion method, and more preferably are the couplers having a solubility in dibutylphthalate at 25° C. higher than 9 grams per 100 grams of solvent. Said couplers can be dispersed, in absence of the primary solvent, in the gelatin water solutions without any crystallization phenomenon occurring in the photographic material even after coating and drying.

Specific examples of magenta couplers used in the present invention are reported hereinbelow; the present invention is not anyhow intended to be limited to such examples.

(A)

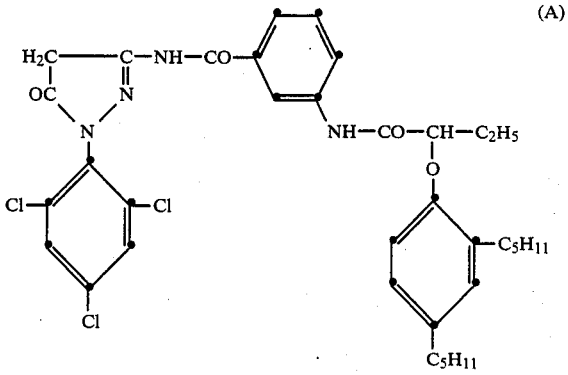

-continued (B)

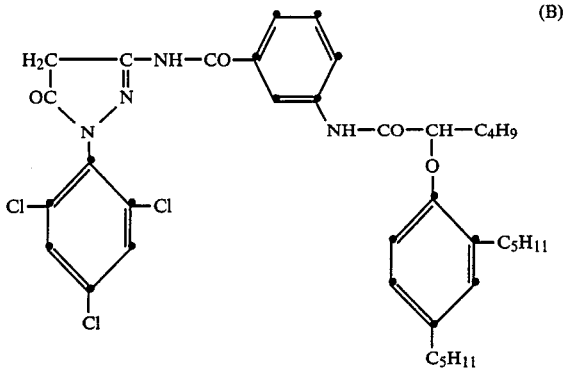

(C)

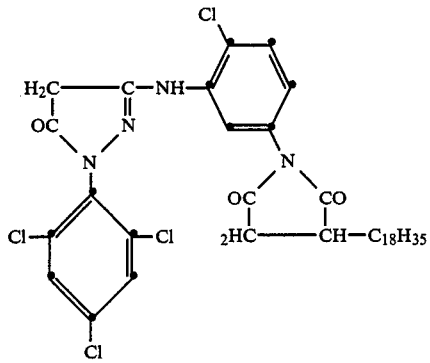

(D)

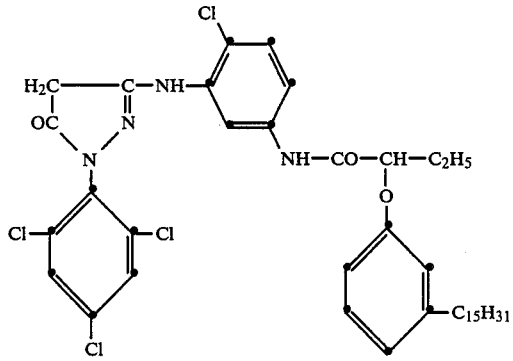

According to the present invnetion, the magenta coupler has been found to be more stable against the action of formaldehyde and other aldehydes if present as a dispersion in the layer in the absence of a significant presence of a primary oil; the photographic material incorporating the magenta coupler according to the present invention, even if stored for a long time both prior to and after exposure and before development in the presence of aldehyde traces, is therefore stabilized against color density decrease and fog increase. The magenta coupler-containing layer (which usually is the green-sensitive layer, even if in photography it is possible, but not preferable, to incorporate a coupler in a layer sensitive to a light having a wavelength not complementary with the color of the coupler after development), according to the present invention, is free from the presence of oil; some oil however may be present in a quantity as not to substantially modify the stability of the photographic material against exposure to aldehyde traces, preferably in a quantity not higher than 20% by weight with respect to the magenta coupler, more preferably not higher than 10% and most preferably not higher than 5%. Accordingly, the term "in the absence of a significant presence of", as used herein, means in absence of a quantity of oil which, if present as a solvent for the coupler, would significantly impair the stability of the coupler itself. Preferably, said undesired quantity of solvent is higher than 20% by weight with respect to the coupler, more preferably higher than 10%, most preferably higher than 5%.

According to the present invention, in the case of more magenta coupler-containing layers, at least one of them is coated in the absence of a significant presence of oil. As known in the art (see for instance GB Pat. No. 923,045; U.S. Pat. No. 8,843,369 and GB Pat. No. 1,576,991) the green sensitive layer may consist of two or more adjacent or separated layers having the same green sensitivity but different speed associated with said magenta couplers; at least one of these layers, generally the least sensitive layer, contains the highest quantity of the coupler and is responsible of the highest density of the magenta dye with respect to the total green-sensitive layers and it is such layer that, according to the present invention, is coated in the absence of a significant presence of oil. In the case of more magenta coupler-containing layers, all said layers are anyhow preferred to be coated in the absence of oil.

Couplers capable upon development of giving yellow and cyan dyes are associated with silver halide emulsion layers respectively sensitive to the blue and red regions. Suitable couplers are those having non-diffusing hydrophobic groups, such as organic groups with a carbon atom number from 8 to 32, introduced into the coupler molecule. Such group, called a ballasting group, is bonded to the coupler molecule directly or through an imino, ether, carbamoyl, sulfamoyl, etc. bond. Examples of useful ballasting groups are described in U.S. Pat. No. 3,892,572.

In order to introduce said couplers into the silver halide emulsion layers, the oil dispersion method, described as said above in U.S. Pat. Nos. 2,322,027; 2,801,170; 2,801,171; 2,949,360 and 2,991,177, is conveniently employed. Said method consists of dissolving the coupler in a high-boiling and water-insoluble organic solvent and dispersing said solution in a water solution of a hydrophilic colloid (usually gelatin) under the forms of small droplets. The solvent (oil) has a boiling point higher than 175° C., a high solving power for the couplers and the derived dyes and is permeable to the developing solutions. Useful solvents include, for example, carboxylic acid alkyl esters, in which the alkyl radical contains less than 10 carbon atoms, for instance methyl, ethyl, propyl, n-butyl, di-n-butyl, n-amyl, isoamyl and dioctyl phthalate, di-n-butyl adipate, di-isooctyl azelate and butyl laurate, phosphoric acid esters, for instance tricresyl phosphate, triphenyl phosphate and diphenyl mono-p-tert.-butyl phenylphosphate, carboxylic amides, for instance N,N-butylacetanilide, N-methyl-p-methyl-acetanilide, N,N-diethylcaprilamide, N,N-dimethyl-palmitamide, ethers, for instance n-butyl-m-pentadecylphenyl ether, 2,4-tert.butylphenyl ether and substituted hydrocarbons.

In the practice, it is often advantageous to use an auxiliary solvent of the low-boiling water-insoluble type as described above together with the high-boiling water-insoluble oil. Such auxiliary solvent is normally removed during the photographic material manufacturing operations leaving in the layer very small oil droplets which keep the coupler dispersed.

Specific examples of yellow couplers include those described in U.S. Pat. Nos. 2,875,057; 3,265,506; 3,408,194; 3,551,155; 3,852,322; 3,725,072; 3,891,445; 3,894,875; 3,973,968; 3,990,896; 4,008,086; 4,012,259; 4,022,620; 4,029,508; 4,046,575; 4,057,432; 4,059,447; 4,095,983; 4,133,958; 4,157,919; 4,182,630; 4,186,019; 4,203,768; 4,206,278 and 4,266,019, in DE Pat. No. 1,547,868, in DE patent application Ser. Nos. 2,213,461; 2,219,917; 2,261,361; 2,263,875; 2,414,006; 2,528,683; 2,935,849 and 2,936,842, in GB Pat. No. 1,425,020, in JA patent applications Ser. Nos. 26133/72, 66835/73, 6341/75, 34232/75, 87650/75, 130422/75, 75521/76, 102636/76, 145319/76, 21827/76, 82424/77, 115219/77, 48541/79, 121126/79, 2300/80, 36900/80, 38576/80, 70841/80, 161239/80 and 87041/81, in JA Pat. Nos. 13576/74, 10783/76, 36856/79 e 13023/80 and in Research Disclosure No. 18053.

Specific examples of cyan couplers include those described in U.S. Pat. Nos. 2,369,929; 2,434,272; 2,474,293; 2,521,908; 2,895,826; 3,034,982; 3,311,476; 3,458,315; 3,476,563; 3,583,971; 3,591,383; 3,758,308; 3,767,411; 4,004,929; 4,052,212; 4,124,396; 4,146,396; 4,205,990; 4,228,233; 4,254,212 and 4,264,722, in DE patent application Ser. Nos. 2,214,389; 2,414,830; 2,454,329; 2,634,694; 2,841,166; 2,934,769; 2,945,813; 2,947,707 and 3,055,355, in JA Pat. Nos. 37822/79 and 37823/79, in JA patent application Ser. Nos. 5055/73, 59838/73, 130441/75, 26034/76, 146828/76, 69624/77, 90932/77, 52423/78, 105266/78, 110530/78, 14736/79, 48237/79, 66129/79, 131931/79, 32071/80, 65957/80, 73050/80, 108662/80, 1938/81, 12643/81, 55945/81, 65134/81 and 80045/81.

Preferably, the color photographic material of the present invention comprises a subbed cellulose triacetate support base having coated thereon in the indicated order one gelatin layer containing black colloidal silver as a antihalo layer, a first low-sensitivity red-sensitive emulsion layer containing a phenolic type cyan coupler dispersed in oil, a second high-sensitivity red-sensitive emulsion layer containing a phenolic cyan coupler dispersed in oil, a gelatin interlayer, a first low-sensitivity green-sensitive emulsion layer containing a 5-pyrazolone magenta coupler present as a dispersion in the absence of a significant presence of oil, a second high-sensitivity green-sensitive emulsion layer containing 5-pyrazolone magenta coupler present as a dispersion in the absence of a significant presence of oil, a gelatin layer containing yellow colloidal silver as a yellow filter, a first low-sensitivity blue-sensitive emulsion layer containing a ketomethylenic type open-chain yellow coupler dispersed in oil, a second high-sensitivity blue-sensitive emulsion layer containing the yellow coupler dispersed in oil and a gelatin protective layer.

The above described photographic materials are particularly useful as reversal type color materials to obtain color images on a transparent base upon exposure and development in a reversal type processing. Such reversal processing, generally, includes a first black-and-white development, a re-exposure or a reversal bath, a second color development and a bleach-fixing process. Unlike color photographic materials of the negative type, such reversal materials do not make use of colored or masked couplers to correct colors, as described e.g. in U.S. Pat. Nos. 2,434,272; 3,386,301; 3,476,560; 3,476,564 and 3,394,802 and in GB Pat. No. 1,464,361.

The silver halide emulsions used in the present invention can be formed from a fine dispersion of silver bromide, chloride, chloro-bromide, iodo-bromide and iodo-chloro-bromide and their mixtures in a hydrophilic colloid. Any hydrophilic colloid conventionally used in photography can be used as a hydrophilic colloid, e.g. gelatin, a gelatin derivative such as acilated gelatin, graft gelatin, etc., albumin, gum arabic, agar agar, a cellulose derivative such as hydroxyethyl-cellulose, carboxymethyl-cellulose, etc., a synthetic resin such as polyvinyl alcohol, polyvinyl pyrrolidone, polyacrylamide, etc. Preferred silver halides are silver iodo-bromide or silver iodo-chloro-bromide containing from 1 to 12% iodide moles. The silver halide crystals may have any shape, they may be for instance cubic, octahedric, tabular in shape or have mixed shapes. The silver halide may have a narrow or wide size distribution. Their size generally ranges from 0.1 to 3 micron. The silver halide emulsions may be prepared by using a single-jet or double-jet method or a combination of such methods and may be ripened, e.g., with an ammonia, a neutralization, an acid method, etc.

The emulsions used in the present invention may be chemically and optically sensitized as described in Research Disclosure No. 17643, III e IV, December 1978; they may contain optical brighteners, antifog agents and stabilizers, filtering and antihalo dyes, hardeners, coating aids, plasticizers and lubricants and other auxiliary substances, as for instance described in Research Disclosure No. 17643, V, VI, VIII, X, XI and XII, December 1978.

The photographic emulsion layers and the other layers of the photographic element may contain various colloids, alone or in combination, as supporting materials, as described e.g. in Research Disclosure No. 17643, IX, December 1978.

The above described emulsions may be coated on different support bases (cellulose triacetate, paper, resin-coated paper, polyester) by using different coating techniques, as described in Research Disclosure No. 17643, XV and XVII, December 1978.

The light-sensitive silver halides contained in the photographic elements of the present invention, after being exposed, can be processed to form a visible image by associating them to an alkaline aqueous medium in the presence of a developing agent contained in the medium or element. Processing formulations and techniques are described in Research Disclosure No. 17643, XIX, XX and XXI, December 1978.

The present invention is now described with more details by making reference to the following examples.

EXAMPLE 1

Grams 8 of magenta coupler A were dissolved at 60° C. in a mixture of 10 ml of ethyl acetate, 2 ml of tricresylphosphate and 2 ml of dibutylformamide (oils) and the obtained solution was added to 48 ml of a 10% gelatin water solution containing 4 ml of a water solution of 10% Hostapur TM SAS (an alkylsulfonate of Hoechst AG) at 45° C. The obtained mixture was dispersed upon emulsification in a colloidal mill. The obtained dispersion was added to 133 g of a gelatin emulsion containing 50% of silver bromoiodide crystals having 5% silver iodide moles and a mean diameter of 0.3 μm and 50% of silver bromo-iodide crystals having 7% silver iodide moles and a mean size of 0.6 μm. Prior to the addition of the coupler dispersion, both emulsions had been chemically sensitized with gold and thiosulfate. The mixture of both emulsions was then added with green spectral sensitizers and a stabilizer and then coated onto a subbed cellulose triacetate base. The obtained layer was then overcoated with a gelatin protective layer containing a hardener. After drying; a photographic material (Film A) was obtained having a silver coverage of 1.5 g/m$^2$, a coupler-to-silver ratio of 0.90, an oil-to-coupler ratio of 0.5 and a gelatin-to-coupler ratio of 2.7.

Grams 8 of the same magenta coupler A were dissolved in 10 ml of ethyl acetate and 1 g of Span-20 TM (a sorbitan monolaurate of Atlas Chemical Industries, Inc.) at 60° C. and the obtained solution was added to 48 ml of a 10% gelatin water solution containing 4 ml of a water solution of 10% Hostapur TM SAS at 45° C. The resulting mixture was dispersed upon emulsification in a colloidal mill. The resulting dispersion was used to obtain a photographic material (Film B) by following the same procedure as described for Film A. Film B had a silver coverage of 1.5 g/m$^2$, a coupler-to-silver ratio of 0.90, a gelatin-to-coupler ratio of 2.7 and was characterized by the absence of oils.

Samples of both films were kept for 24 hours at room temperature in a closed tank wherein the atmosphere had been balanced by means of a liquid phase consisting of 350 g of glycerine, 650 g of water and 6 ml of a 40% formaldehyde water solution (reference conditioning treatment).

Samples of the films, thus conditioned, were exposed in daylight and developed in a conventional processing for color reversal photographic materials E6 as described in Kodak Publication N. 2-119 in comparison with the samples of the two unconditioned films. The magenta color maximum density of the samples was measured and the color maximum density of the conditioned sample was substracted from that of the unconditioned sample of the same film (residual maximum density).

The following table reports the percentage of the residual maximum density of both films.

TABLE 1

| Film | Residual Density Percentage |
|---|---|
| A (comparison) | 24 |
| B (invention) | 57 |

An improvement according to the present invention is obtained in a conventional Film I, containing the coupler as a dispersion in oil, when the oil percent is reduced,—to get a Film I'—, to such a level as to give a raise,—in Film I' with respect to Film I—, in Residual Density Percentage (RDP) value of at least 10 after Film I and Film I' have been conditioned according to the said reference conditioning treatment and conventionally processed, as described.

EXAMPLE 2

Grams 8 of coupler B were dissolved in 60° C. in a mixture of 10 ml of ethyl acetate, 2 ml of tricresylphosphate and 2 ml of dibutylformamide (oils) and 1 g of Span-20 TM and the obtained solution was added to 48 ml of a 10% gelatin water solution containing 4 ml of a water solution of 10% Hostapur TM SAS at 45° C. The so-obtained mixture was dispersed upon emulsification in a colloidal mill. The resulting dispersion was used to obtain a photographic material (Film C) by following the same procedure described for Film A of Example 1.

Grams 8 of the same coupler B were dissolved in 10 ml of ethyl acetate and 1 g of Span-20 TM at 60° C. and the obtained solution was added to 48 ml of a 10% gelatin water solution containing 4 ml of a water solution of 10% Hostapur TM SAS at 45° C. The resulting mixture was dispersed upon emulsification in a colloidal mill. The resulting dispersion was used to obtain a photographic material (Film D) by following the same procedure described for Film A of Example 1.

Samples of both films were processed as described in Example 1. The following Table reports the residual maximum density percentage values.

TABLE 2

| Film | Residual Density Percentage |
|---|---|
| C (comparison) | 20 |
| D (invention) | 62 |

EXAMPLE 3

8 Grams of 1-(2',4',6'-trichlorophenyl)-3-[3''-(2''',4'''-ditert.-amylphenoxyacetamido)-benzamido]-5-pyrazolone magenta coupler were dissolved at 60° C. in a mixture of 8 ml of ethyl acetate, 2 ml of tricresylphosphate and 2 ml of dibutylformamide (oils) and 1 g of Span-20 TM and the obtained solution was added to 32 ml of a 10% gelatin water solution containing 2.5 ml of a water solution of 10% Hostapur TM SAS at 45° C. The obtained mixture was dispersed upon emulsification in a colloidal mill. The obtained dispersion was added to 127 g of a gelatin emulsion of bromo-iodide crystals having 5% iodide moles and a mean size of the grains of 0.3 μm, chemically sensitized, prior to being added with the coupler, with gold and thiosulfate. The emulsion was then added with green spectral sensitizers and a stabilizer and coated on two red-sensitive silver halide emulsion layers having different sensitivity associated with oil-dispersed cyan couplers on their turn coated on a subbed cellulose triacetate support base. Another portion of the above described dispersion was added to 149 g of a gelatin emulsion of silver bromo-iodide crystals having 7% iodide moles and a mean size of 0.6 μm, chemically sensitized, prior to being added with the coupler, with gold and thiosulfate. The emulsion was added with a green spectral sensitizer, a stabilizer and coated as second green-sensitive layer onto the first above described green-sensitive layer. Both green-sensitive layers were then overcoated in the indicated order with a gelatin layer containing colloidal silver as a yellow filter, a low-sensitivity blue-sensitive emulsion layer associated with an oil-dispersed yellow coupler, a high-sensitivity blue-sensitive emulsion layer associated with a yellow coupler and a hardener-containing gelatin layer as a protective layer. The obtained photographic material (Film E), in the first green-sensitive layer, had a silver coverage of 0.69 g/m$^2$, 0.80 g/m$^2$ of coupler, 0.40 g of oil and a gelatin-to coupler ratio of 2.5 and, in the second green-sensitive layer, a silver coverage of 0.83 g/m$^2$, 0.55 g/m$^2$ of coupler and 0.27 g of oil and a gelatin-to-coupler ratio of 2.67.

8 Grams of the magenta coupler A were dissolved in 10 g of ethyl acetate and 1 g of Span-20 TM at 60° C. and the obtained solution was added to 48 g of a 10% gelatin water solution containing 4 ml of a water solution of 10% Hostapur TM SAS at 45° C. The resulting mixture was dispersed upon emulsification in a colloidal mill and used to obtain a photographic material (Film F) by following the same procedure as described for Film E above. Film F had, in the first green-sensitive layer, a silver coverage of 0.68 g/m$^2$, 0.069 g/m$^2$ of Span-20 TM and a gelatin-to-coupler ratio of 3.5 and, in the second green-sensitive layer, a silver coverage of 0.55 g/m$^2$, 0.58 g of coupler, 0.072 g of Span-20 TM and a gelatin-to-coupler ratio of 1.7.

The following Table reports the residual maximum density percentage of both films.

TABLE 3

| Film | Residual Density Percentage |
|---|---|
| E (comparison) | 37 |
| F (invention) | 67 |

We claim:

1. A process for the formation of a color image upon exposure and reversal development of a photographic material comprising a support base and, coated thereon, at least one red-sensitive silver halide emulsion layer associated with dispersed hydrophobic non-diffusing cyan couplers, at least one green-sensitive silver halide emulsion layer associated with dispersed hydrophobic non-diffusing magenta couplers and at least one blue-sensitive silver halide emulsion layer associated with dispersed hydrophobic non-diffusing yellow couplers, characterized by the fact that at least one green-sensitive layer is developed in the presence of a magenta coupler present as a dispersion in an organic solvent which has a boiling temperature of 50° to 175° C. and a water solubility less than 10 parts by weight per 100 parts of water at 20° C. in said green-sensitive layer in the absence of a significant presence of oil.

2. A color photographic material comprising a support and coated thereon at least one red-sensitive silver halide emulsion layer associated with oil-dispersed hydrophobic non-diffusing cyan couplers, at least one green-sensitive silver halide emulsion layer associated with a hydrophobic non-diffusing magenta coupler present as a dispersion in an organic solvent which has a boiling temperature of 50° to 175° C. and a water solubility less than 10 parts by weight per 100 parts of water at 20° C. in said green-sensitive layer in the absence of a significant presence of oil, and at last one blue-sensitive silver halide emulsion layer associated with oil-dispersed hydrophobic non-diffusing couplers.

3. A process for stabilizing the sensitometric properties of a color photographic material, said photographic material comprising a support base having, coated thereon, at least one red-sensitive silver halide emulsion layer associated with dispersed hydrophobic non-diffusing cyan couplers, at least one green-sensitive silver halide emulsion layer associated with a hydrophobic non-diffusing magenta coupler and at least a blue-sensitive silver halide emulsion layer associated with dispersed hydrophobic non-diffusing yellow couplers, which process consists of coating at least one green-sensitive layer in an organic solvent which has a boiling temperature of 50° to 175° C. and a water solubility less than 10 parts by weight per 100 parts of water at 20° C. in the absence of a significant presence of oil.

4. The process of claim 3 wherein the magenta coupler comprises a reactive methylenic group.

5. The process of claim 3 wherein the magenta coupler is a 4-equivalent 5-pyrazolone coupler.

6. The process of claim 3 wherein the magenta coupler corresponds to the following general formula:

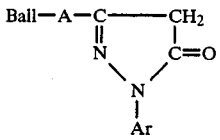

wherein Ball is a ballasting group; A is a —CONH—, —NH—, —NHCONH— or —NHCOO— group and Ar is a substituted or nonsubstituted aryl group.

7. The process of claim 6 wherein the ballasting group corresponds to general formula:

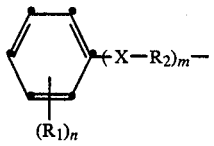

wherein X is an oxygen atom or a sulfur atom; $R_2$ is a branched or linear alkylene group; $R_1$ is a hydrogen atom, a halogen atom, an alkyl group, an aryl group, a heterocyclic group, an aralkylic group, an aryloxy group, a hydroxy group, an acyloxy group, an alkoxycarbonyl group, an aryloxycarbonyl group, an alkylthio group, an arylthio group, an alkylsulfonyl group, an arylsulfonyl group, an acyl group, an acylamino group, a sulfonamido group, a carbamoyl group or a sulfamoyl group; n is 0,1,2 or 3 and m is 0 or 1, with the proviso that the sum of the carbon atoms of $R_1$ and $R_2$ is at least 8.

8. The process of claim 3 wherein each green-sensitive layer associated with a magenta coupler is formed by coating a composition obtained by adding the silver halide emulsion with a magenta coupler dispersion in a gelatin water solution, said dispersion being obtained by dispersing in said gelatin water solution a solution of the magenta coupler in a substantially water-immiscible low-boiling solvent in the presence of an anionic surfactant.

9. The process of claim 8 wherein said anionic surfactant is an alkyl sulfonate.

10. The process of claim 8 wherein said dispersion, further to the anionic surfactant, comprises a non-ionic surfactant.

11. The process of claim 10 wherein said non-ionic surfactant is a sorbitan ester.

12. The material of claim 2 wherein an anionic surfactant is present with both said organic solvent and said magenta coupler.

13. The material of claim 2 wherein said organic solvent is an ester of an aliphatic alcohol.

14. The material of claim 12 wherein said organic solvent is an ester of an aliphatic alcohol.

15. The process of claim 1 wherein said organic solvent is an ester of an aliphatic alcohol.

16. The process of claim 3 wherein said organic solvent is an ester of an aliphatic alcohol.

17. The process of claim 5 wherein said organic solvent is an ester of an aliphatic alcohol.

18. The process of claim 6 wherein said organic solvent is an ester of an aliphatic alcohol.

19. The process of claim 7 wherein said organic solvent is an ester of an aliphatic alcohol.

* * * * *